United States Patent [19]

Jülke et al.

[11] Patent Number: 4,559,167

[45] Date of Patent: Dec. 17, 1985

[54] ZINC OXIDE VARISTOR

[75] Inventors: Elias Jülke, Wettingen; Tony Kaiser, Buchs; Maged A. Osman, Zürich; Roger Perkins, Baden-Rütihof, all of Switzerland

[73] Assignee: BBC Brown, Boveri & Company, Limited, Baden, Switzerland

[21] Appl. No.: 676,303

[22] Filed: Nov. 29, 1984

[30] Foreign Application Priority Data

Dec. 22, 1983 [CH] Switzerland ..... 6851/83

[51] Int. Cl.[4] ..... H01C 7/10

[52] U.S. Cl. ..... 252/518; 252/500; 252/519; 106/287.17; 106/287.19; 106/287.22; 428/425.9; 428/447; 428/454; 428/480; 428/689; 428/697; 524/408; 524/409; 524/406; 524/413; 524/449; 338/20; 338/21

[58] Field of Search ..... 252/500, 518, 519; 106/287.18, 287.19, 287.22; 428/425.9, 447, 428/454, 480, 689, 697; 524/406, 408, 409, 413, 449

[56] References Cited

U.S. PATENT DOCUMENTS

| | | | |
|---|---|---|---|
| 3,798,063 | 3/1974 | Decraene | 252/519 |
| 3,872,582 | 3/1975 | Matsuoka et al. | 252/519 |
| 3,938,069 | 2/1976 | May | 252/518 |
| 4,031,498 | 6/1977 | Hayashi et al. | 252/518 |
| 4,210,704 | 7/1980 | Chandross et al. | 252/500 |
| 4,247,364 | 1/1981 | Culp | 428/454 |

*Primary Examiner*—Prince E. Willis
*Assistant Examiner*—Robert A. Wax
*Attorney, Agent, or Firm*—Burns, Doane, Swecker & Mathis

[57] ABSTRACT

A varistor of metal oxides, predominantly zinc oxide (ZnO), is provided on its lateral surface between two contact faces, with a coating consisting at least partially of an organic polymer. In order to prevent rapid degradation in oxygen-free surroundings, the coating contains at least one oxygen barrier layer or is formed entirely as such a layer, which contains filler particles in an organic matrix material. The filler is here taken from the group comprising the following substances or groups of substances: synthetic mica, natural mica, vermiculite, micaceous iron ore, glass and other non-metallic inorganic substances present in the form of platelets or flakes; metal oxides, active part material in a pulverulent form and other oxygen-releasing inorganic substances. The organic matrix material is selected from the group comprising epoxide resins, alkyd resins, polyurethanes, silicone resins, unsaturated polyester resins and acrylates. The oxygen barrier layer or layers can be formed by a coating consisting of a band with a carrier of paper, plastic or glass fabric, the band being wound once or several times around the active part.

9 Claims, 5 Drawing Figures

ZINC OXIDE VARISTOR

BACKGROUND OF THE INVENTION

The invention relates to a zinc oxide varistor.

It is known that the properties of zinc oxide varistors deteriorate markedly after a relatively short time, if they are operated in oxygen-free surroundings. In particular, the leakage current and hence the energy absorption increase, and this leads to heating-up and consequently to a further increase in the leakage current and, as the final outcome, to thermal destruction of the varistor. It has been found that the degradation of the varistor material occurs principally in a thin lateral edge layer, and it is therefore suspected that it is to be ascribed to the formation of less than stoichiometric zinc oxide as a result of oxygen diffusing out of the edge layer into the surroundings of the varistor.

DE No. 3,123,552 A1 discloses a varistor which, in order to prevent or slow down the out-diffusion of oxygen, is provided, on the side face going round between its contact surfaces, with a coating of an organic polymer, which should be gas-permeable.

In fact, at the usual operating temperature of zinc oxide varistors, namely about 120°–130° C., the oxygen permeability of organic polymers is in general fairly high and it appears doubtful whether a pure polymer coating can form an oxygen barrier which substantially slows the degradation of the zinc oxide varistor.

From U.S. Pat. No. 3,959,543, it is also known to provide zinc oxide varistors with a glass coating on the side. As is clear, particularly from the above mentioned patent, glass having a coefficient of thermal expansion which is sufficiently close to that of the varistor material has a relatively high melting point. In order to apply the glass coating, the varistor must, after it has been finished, be heated once more to about 650° C., and this can have unfavorable effects on its electrical properties. Further disadvantages are the brittleness of the glass coating, making handling of the varistor more difficult, and the fact that the coating can, under certain circumstances, be chemically corroded by hydrofluoric acid.

According to Japanese Patent Specification No. 957,072, the degradation of zinc oxide varistors in $SF_6$ can be substantially slowed down by an addition of 10–30% of oxygen. Apart from the fact that it is not applicable if the varistors are surrounded by a liquid or solid medium, this method has the disadvantage that it requires gas-tight sealing of the space containing the varistors from other parts of the equipment and makes maintenance more complicated. In addition, the dielectric strength is reduced.

OBJECTS AND SUMMARY OF THE INVENTION

It is the object of the invention to improve a zinc oxide varistor of the generic type with respect to the oxygen impermeability of the coating which covers the lateral surface.

The advantages of the invention are principally that the oxygen barrier layer, of which there is at least one and which is contained in the coating of a zinc oxide varistor according to the invention, has a substantially greater counter-action against a diffusion of oxygen out of the edge layer of the varistor part than the coating of known zinc oxide varistors of the same generic type, because of the inclusion of an inorganic filler which is substantially oxygen-impermeable and drastically lengthens the diffusion paths or itself releases oxygen. In addition, it is no more difficult to prepare the coating of a zinc oxide varistor according to the invention.

Since the function of blocking the oxygen diffusion through the coating, or at least reducing it, is fulfilled essentially by the inorganic filler finely divided in the oxygen barrier layer, the organic matrix material, which substantially determines the mechanical, thermodynamical and chemical properties of the said oxygen barrier layer, can in addition be optimised with respect to heat resistance, elasticity, coefficient of thermal expansion, corrosion resistance, mechanical strength and the like; and, in particular, can also be adapted, substantially without taking account of its oxygen permeability, to the specific requirements given by the particular conditions of use, such as, for example, the surrounding medium.

DETAILED DESCRIPTION OF THE ILLUSTRATED EMBODIMENTS

In FIGS. 1–4, zinc oxide varistors are shown which, in their principal structure, each contain a cylindrical active part 1 of a sintered mass which consists of metal oxides having a predominant proportion of zinc oxide, as well as contact layers 2*a, b* on the bottom and top faces of the active part 1, which contact layers consist of a conductive material, for example aluminium, and form mutually opposite contact faces 3*a, b*. The lateral face between the contact faces 3*a, b* is covered by a coating 4 which includes, at least partially, an organic polymer.

Figure 1:
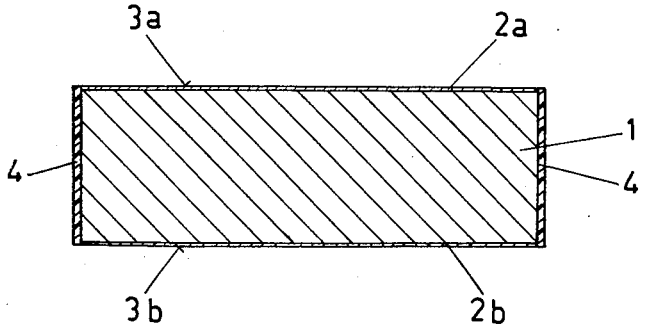
FIG. 1 shows an axial section through a zinc oxide varistor of the generic type.
Figure 2:
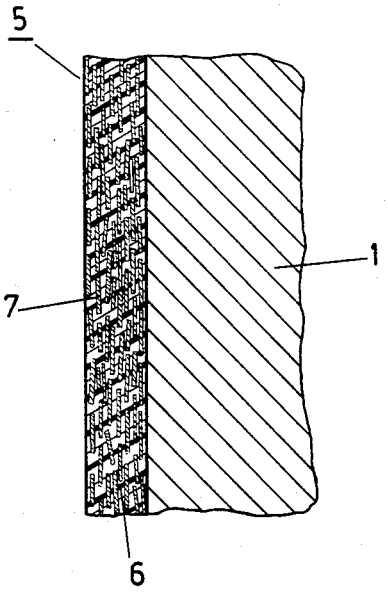
FIG. 2 shows a section through the edge zone of a zinc oxide varistor according to the invention, in accordance with a first embodiment.

According to a first embodiment illustrated in FIG. 2, the coating 4 is formed, according to the invention, entirely as an oxygen barrier layer 5. Filler particles 7 are distributed in an organic matrix material 6. The particles are in the form of platelets and are selected from one of the following materials: natural mica, synthetic mica, vermiculite, micaceous iron ore or glass. Suitable organic matrix materials 6 are epoxide resins, alkyd resins, polyurethanes, silicone resins, unsaturated polyester resins and acrylates. These substances are also commercially available as surface-coatings. They can be mixed with the filler and the side face of the uncoated active part can be sprayed several times with this mixture. Whirl-sintering or electrostatic powder-coating are also possible methods for applying the oxygen barrier layer. Casting-in is also possible, but is less suitable for mass production.

The probable reason for the degradation-inhibiting fact of the oxygen barrier layer 5 is that the filler particles 7 which are virtually impermeable for oxygen are oriented substantially parallel to the side face of the active part 1 and hence form a dense structure in which diffusion paths, running exclusively in the organic matrix material 6, through the oxygen barrier layer 5 are very long compared with the thickness of the latter. Oxygen which has diffused out of the edge layer of the acive part 1 is thus retained in the neighbourhood of the edge layer, so that the oxygen partial pressure is increased there and further diffusion of oxygen out of the active part 1 is prevented.

Zinc oxide varistors according to the invention, in accordance with the first embodiment, were produced approximately in the following variants:

In a first variant (type I), the side face of the active part 1 was sprayed three times with Wacotop® (registered trademark of Messrs. Heinrich Wagner & Co., Zürich, Switzerland), which is an epoxide resin finish containing micaceous iron ore. The thickness of the oxygen barrier layer 5 was 0.5 mm.

In a second variant (type II), the side face of the active part 1 was sprayed three times with Synodur® (registered trademark of Messrs. Dold AG, Wallisellen, Switzerland), which is an epoxide resin finish containing mica. The thickness of the oxygen barrier layer 5 was again 0.5 mm.

Figure 3:
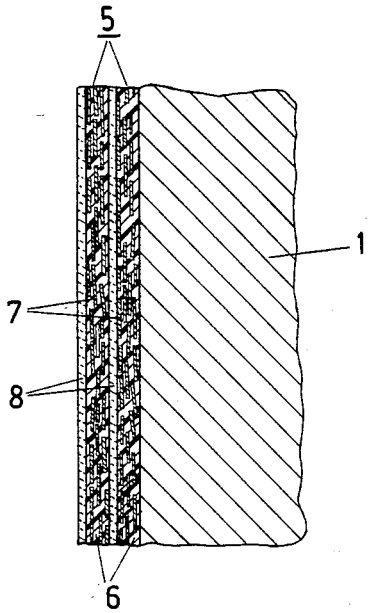
FIG. 3 shows a similar section for a zinc oxide varistor according to the invention, in accordance with a second embodiment.

According to a second embodiment, illustrated in FIG. 3, one or more oxygen barrier layers 5 are formed according to the invention by a coating consisting of a mica band with a carrier 8 of paper, plastic or glass fabric, the band being wound in one or more plies around the active part 1. The coating here faces the active part 1, and the carrier 8 is located on the outside. The coating again consists of an organic matrix material 6 with embedded filler particles 7. As a suitable filler, glimmer is preferred, but the use of other substances listed in conjunction with the embodiment already explained or that described below is also possible.

The mode of action of the oxygen barrier layer or layers 5 is of course the same as in the other embodiments. However, the carrier 8 makes it possible to apply oxygen barrier layers 5 very simply and quickly by machine-winding.

A varistor according to the invention, in accordance with the second embodiment, was produced in the following way (type III):

The cylindrical active part 1 was covered with a ply of Samicatherm® (registered trademark of Messrs. Isola, Breitenbach, Switzerland) mica/glass fabric band, adhesively bonded and curved for 16 hours at 130° C. The thickness of the band was 0.2 mm.

Figure 4:
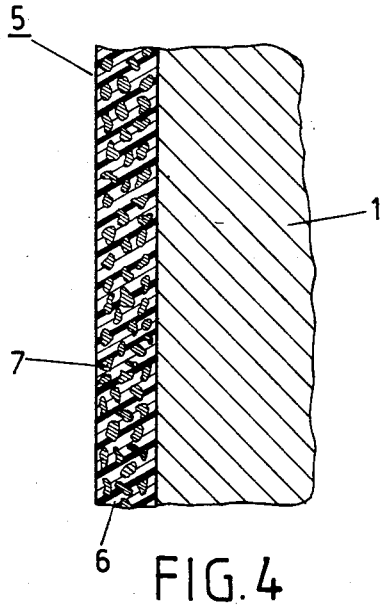
FIG. 4 shows a similar section for a zinc oxide varistor according to the invention, in accordance with a third embodiment.

According to a third embodiment, illustrated in FIG. 4, the entire coating 4 is, according to the invention, again formed entirely as an oxygen barrier layer 5. Filler particles 7 are here distributed in an organic matrix material 6 and consist of one of the following metal oxides: iridium oxide ($IrO_2$), Osmium oxide ($Os_2$), tellurium oxide ($TeO_2$), copper oxide ($Cu_2O$), bismuth oxide ($Bi_2O_3$), lead oxide (PbO), antimony oxide ($Sb_2O_3$), cobalt oxide (CoO), nickel oxide (NiO), manganese oxide ($MnO_2$, $Mn_2O_3$), cadium oxide (CdO), molybdenum oxide ($MoO_3$), tin oxide ($SnO_2$), tungsten oxide ($WO_3$), iron oxide ($Fe_3O_4$), vanadium oxide ($V_2O_5$) or zinc oxide (ZnO). Pulverulent active part material can also be used. Suitable organic matrix materials are those listed in conjunction with the first embodiment.

The degradation-delaying effect of the coating may be explained in such a way that the filler particles 7 release oxygen and maintain the oxygen partial pressure of the surroundings in the immediate neighbourhood of the edge layer of the active part 1 at a level, at which the active part material releases only very little oxygen or none at all. The physical effect of the filler, which in most cases has a low oxygen permeability, as a diffusion barrier probably also plays a role.

A zinc oxide varistor according to the invention, in accordance with the third embodiment, was realized in the following form (type IV):

Araldite® (registered trademark of Messrs. Ciba Geigy, Basel, Switzerland) Cy 227 epoxide molding material was mixed with the appropriate hardener Cy 227 and with white seal grade zinc oxide (ZnO) heated to 160°. The lacquer/hardener/zinc oxide ratio was 25:25:50 in percent by weight. The active part 1 was cast in with this mixture, in a silicone casting mold. Subsequently, hardening took place for 16 hours at 130° C. The thickness of the oxygen barrier layer 5 after hardening was 2mm.

The preparation of a similar coating by spraying the side face of the active part 1 with a zinc oxide-containing epoxide resin lacquer was also tested, with a satisfactory result.

In the operation of known zinc oxide varistors of the generic type and of zinc oxide varistors according to the invention, produced as described, for 48 hours in an $SF_6$ atmosphere at 1 bar, 130° C. and 0.34 times the residual voltage, the following results were obtained for the percentage change in power loss:

| | |
|---|---|
| Polyimide coating | 33% |
| Type I | 20% |
| Type II | 6% |
| Type III | 2% |
| Type IV | 15% |

Figure 5:
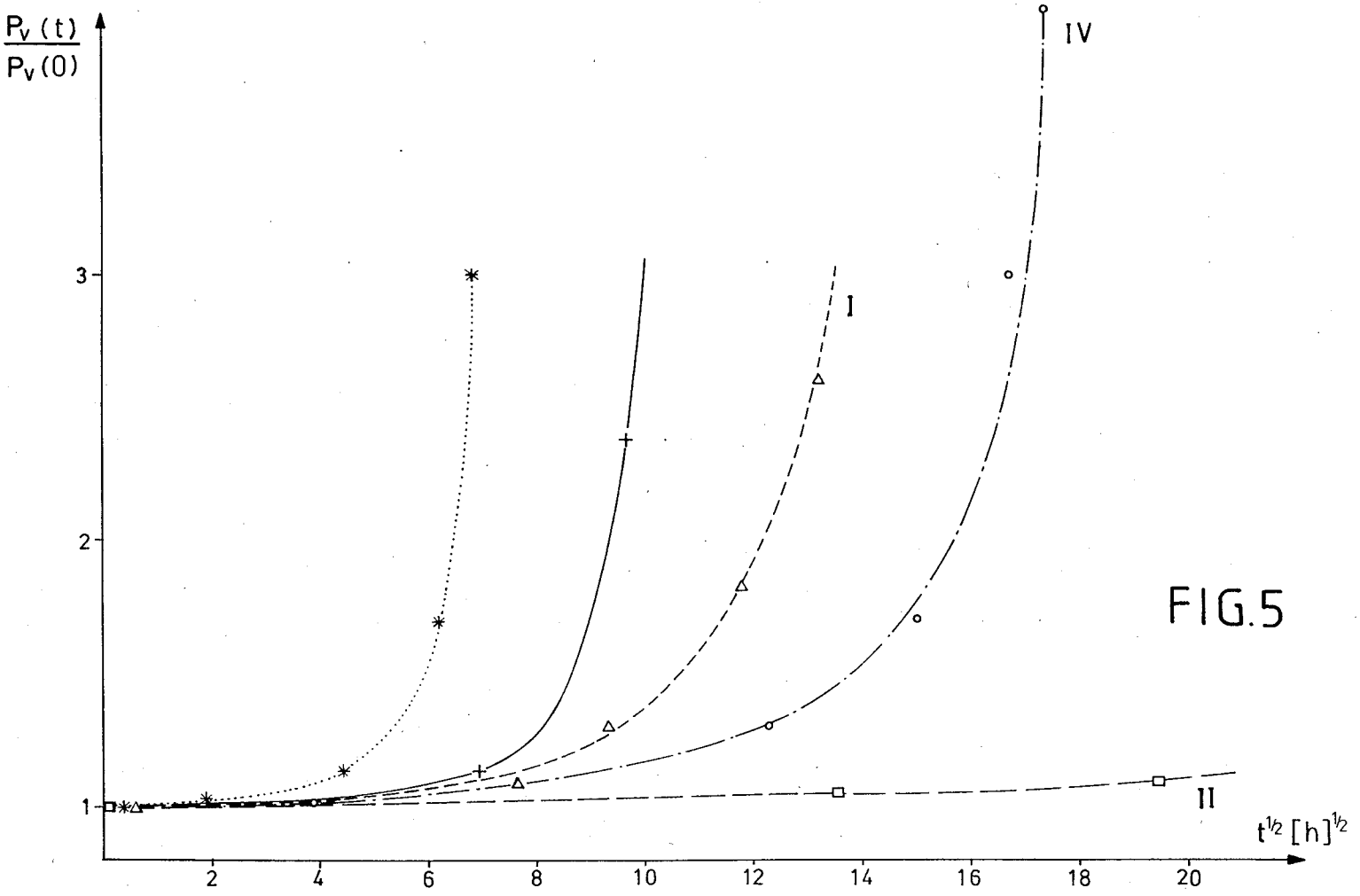
FIG. 5 shows the relative change in time of the power loss of various zinc oxide varistors of the generic type, when they are operated in an $SF_6$ atmosphere.

The time curve of the power loss as compared with the initial power loss Pv(t)/Pv(O) during operation in an $SF_6$ atmosphere at 1 bar, 115° C. and 0.34 times the residual voltage was measured and is shown in FIG. 5 for uncoated active parts (dotted curve), known zinc oxide varistors of the generic type with polyimide coating (full curve), zinc oxide varistors according to the invention, produced as described above, of type I (short-dashed curve), of type II (long-dashed curve) and of type IV (dot-and-dashed curve). As the illustration shows, the degradation of zinc oxide varistors of the generic type can be substantially slowed down by the measures according to the invention. The best results were here obtained with zinc oxide varistors of type II according to the invention.

We claim:

1. A zinc oxide varistor comprising a body composed predominantly of zinc oxide, two mutually opposite contact faces and a lateral surface extending around the body and between the contact faces, a coating on said lateral surface, said coating including at least one oxygen barrier layer comprising an inorganic filler suspended in an organic matrix material of at least one organic polymer, said inorganic filler being an inorganic non-metallic substance, the oxygen diffusion coefficient of which is smaller than that of the organic matrix material.

2. A zinc oxide varistor comprising a body composed predominantly of zinc oxide, two mutually opposite contact faces and a lateral surface extending around the body and between the contact faces, a coating on said lateral surface, said coating including at least one oxygen barrier layer comprising an inorganic filler suspended in an organic matrix material of at least one organic polymer, said inorganic filler being an inorganic substance which releases oxygen when oxygen partial pressure surrounding the lateral surface falls below a defined positive limit value.

3. Zinc oxide varistor according to claim 1, wherein the inorganic non-metallic substance is predominantly in the form of platelets or flakes and is selected from the group consisting of natural mica, synthetic mica, vermiculite, micaceous iron ore and glass.

4. Zinc oxide varistor according to claim 2, wherein the limit value of the oxygen partial pressure in the surroundings, below which the inorganic substances release oxygen, is not lower than in the material of the body.

5. Zinc oxide varistor according to claim 4, in which the inorganic substance which releases oxygen is selected from the group consisting of iridium oxide ($IrO_2$), osmium oxide ($OsO_2$) tellurium oxide ($TeO_2$), copper oxide ($Cu_2$), bismuth oxide ($Bi_2O_3$), lead oxide (PbO), antimony oxide ($Sb_2O_3$), cobalt oxide (CoO), nickel oxide (NiO), manganese oxide ($MnO_3$), tin oxide ($SnO_2$), tungsten oxide ($WO_3$), iron oxide ($Fe_3O_4$), vanadium oxide ($V_2O_5$) and zinc oxide (ZnO).

6. Zinc oxide varistor according to any one of claims 1 to 5, wherein the organic matrix material is predominantly of a polymer selected from the group consisting of epoxide resins, alkyd resins, polyurethanes, silicone resins, unsaturated polyester resins and acrylates.

7. Zinc oxide varistor according to claim 6 wherein the barrier layer comprises an epoxide resin and zinc oxide (ZnO).

8. Zinc oxide varistor according to any one of claims 1 to 5, wherein the at least one oxygen barrier layer is formed by a coating comprising a band with a carrier selected from the group consisting of paper, plastic and glass fabric, and at least one ply of the band is applied to the side face of the body.

9. Zinc oxide varistor according to claim 8, wherein the band is a mica/glass fabric band.

* * * * *